US011433661B2

(12) United States Patent
Magnone

(10) Patent No.: US 11,433,661 B2
(45) Date of Patent: Sep. 6, 2022

(54) FLEXOGRAPHIC PRINTING MACHINE FOR PRINTING A SUBSTRATE WEB

(71) Applicant: KOENIG & BAUER AG, Würzburg (DE)

(72) Inventor: Stefano Magnone, Tortona (IT)

(73) Assignee: KOENIG & BAUER AG, Würzburg (DE)

( * ) Notice: Subject to any disclaimer, the term of this patent is extended or adjusted under 35 U.S.C. 154(b) by 0 days.

(21) Appl. No.: 17/425,976

(22) PCT Filed: May 26, 2020

(86) PCT No.: PCT/EP2020/064565
§ 371 (c)(1),
(2) Date: Jul. 27, 2021

(87) PCT Pub. No.: WO2021/018435
PCT Pub. Date: Feb. 4, 2021

(65) Prior Publication Data

US 2022/0040965 A1 Feb. 10, 2022

(30) Foreign Application Priority Data

Jul. 29, 2019 (DE) ..... 10 2019 120 404.6

(51) Int. Cl.
*B41F 5/24* (2006.01)
*B41F 5/18* (2006.01)
(Continued)

(52) U.S. Cl.
CPC ..... *B41F 5/24* (2013.01); *B41F 5/18* (2013.01); *B41F 23/0466* (2013.01); *B41F 33/0036* (2013.01)

(58) Field of Classification Search
CPC ..... B41F 5/24; B41F 5/18; B41F 23/0466; B41F 33/0036; B41F 23/0479; B41F 23/0483
See application file for complete search history.

(56) References Cited

U.S. PATENT DOCUMENTS 6,176,184 B1 1/2001 Mudry
6,220,157 B1 * 4/2001 Delwiche ..... B41F 5/24 101/178
6,892,639 B2 * 5/2005 Compton ..... B41F 23/0403 101/424.1

FOREIGN PATENT DOCUMENTS

DE 3228681 A1 2/1984
DE 4010261 A1 10/1991
(Continued)

OTHER PUBLICATIONS

International Search Report of PCT/EP2020/064565 dated Oct. 20, 2020.

*Primary Examiner* — Leslie J Evanisko
*Assistant Examiner* — Leo T Hinze
(74) *Attorney, Agent, or Firm* — Mattingly & Malur, PC

(57) ABSTRACT

A flexographic printing press for printing a substrate web comprises at least one printing unit and at least one central cylinder. A plurality of printing couples are arranged around the periphery of the at least one central cylinder. A horizontally aligned dryer unit, having at least one guide element, is arranged above the printing unit in a vertical direction. The at least one horizontally aligned dryer unit has at least two dryer sections with one dryer section being arranged separated from the next dryer section by at least one diverting assembly. The at least one flexographic printing press has at least one roll unwinder and at least one roll winder. The at
(Continued)

least one roll unwinder and the at least one roll winder are arranged on opposite sides of the at least one central cylinder.

15 Claims, 2 Drawing Sheets

(51) Int. Cl.
*B41F 23/04* (2006.01)
*B41F 33/00* (2006.01)

(56) References Cited

FOREIGN PATENT DOCUMENTS

| | | | |
|---|---|---|---|
| EP | 1790471 | A2 | 5/2007 |
| EP | 3078496 | B1 | 10/2017 |
| EP | 3251850 | A1 | 12/2017 |
| JP | 57-157785 | A | 9/1982 |
| WO | 1995/20492 | A1 | 8/1995 |
| WO | 2008034759 | A1 | 3/2008 |

* cited by examiner

FLEXOGRAPHIC PRINTING MACHINE FOR PRINTING A SUBSTRATE WEB

CROSS-REFERENCE TO RELATED APPLICATIONS

This application is the US national phase, under 35 USC § 371, of PCT/EP2020/064565, filed May 26, 2020; published as WO 2021/018435 A1 on Feb. 4, 2021, and claiming priority to DE 10 2019 120 404.6, filed Jul. 29, 2019, the disclosures of which are expressly incorporated herein in their entireties by reference.

FIELD OF THE INVENTION

The present invention relates to a flexographic printing press for printing a substrate web. The flexographic printing press for printing a substrate web comprises at least one printing unit and at least one central cylinder. A plurality of printing couples are arranged around the periphery of the at least one central cylinder. A horizontally aligned dryer unit, having at least one guide element, is arranged above the printing unit in a vertical direction. The at least one horizontally aligned dryer unit has at least two dryer sections. One dryer section is arranged separated from the next dryer section by at least one diverting assembly.

BACKGROUND OF THE INVENTION

In the field of packaging printing, thin and elastic web-format films, in particular plastic films, are frequently used as printing material. To avoid stretching that may result from varying levels of tension and/or heat input and/or pressure, such films are often printed in printing presses that have central cylinders. A plurality of printing couples are arranged distributed in the shape of a star around the circumference of the central cylinder for the purpose of applying different motifs and colors, in particular printing fluids, to the printing material. This enables thin and flexible printing material webs, in particular, to be held and guided precisely during the entire printing process. This is necessary in particular for high register accuracy. Frequently, the printing couples are in the form of flexographic printing couples with raised printing formes and/or printing plates. The printing formes are typically produced on a photopolymer and have, in particular, flexible and elastic properties.

The use of thin and low-viscosity inks makes this printing process suitable in particular for non-absorbent and rough printing material surfaces, as are often typical in the packaging sector, for example.

From EP 3 251 850 A1 a printing press is known, in particular a flexographic printing press comprising a central cylinder with a roll winder and a roll unwinder arranged side by side on the same side of the central cylinder.

Another printing press, in particular a flexographic printing press having a roll winder and a roll unwinder is known from EP 3 078 496 B1. A horizontally arranged dryer with one dryer section is also known from said document.

From DE 40 10 261 A1, a rotary printing press comprising a central cylinder and one or more printing couples arranged around the central cylinder is known. The rotary printing press has in particular a horizontally arranged dryer unit. A plurality of diverting means are arranged in the dryer and a substrate web is turned over multiple times in the dryer. In particular, the rotary printing press has a temperature control roller, which is positioned some distance downstream of the dryer unit on the transport path, especially with guide elements arranged therebetween.

A central cylinder flexographic printing press is known from WO 95/20492. The flexographic printing press comprises a horizontally aligned drying unit having a plurality of guide elements.

A device for drying a printed web is known from DE 32 28 681 A1. The device comprises two dryer sections, in particular, and a plurality of diverting means are arranged in each dryer section.

EP 1 790 471 A2 discloses a device having two dryer sections for drying a web that has been printed in a printing press, in particular a rotary printing press. The device for drying is oriented vertically and has a plurality of guide elements which are arranged offset from one another. The device for drying also has diverting means between the dryer sections.

JP S57 157 785 A discloses a flexographic printing press comprising a central cylinder and a plurality of printing couples arranged on the central cylinder. The central cylinder is arranged between roll unwinders and roll winders. The flexographic printing press additionally comprises a dryer unit having two dryer sections.

U.S. Pat. No. 6,176,184 B1 discloses a flexographic printing press comprising a central cylinder and a plurality of printing couples arranged on the central cylinder. One dryer unit is aligned horizontally and has a plurality of guide elements.

WO 2008/034759 A1 discloses a flexographic printing press comprising a central cylinder and a plurality of printing couples arranged on the central cylinder. One dryer unit is aligned horizontally and has a plurality of guide elements.

SUMMARY OF THE INVENTION

The object of the present invention is to devise a flexographic printing press for printing a substrate web.

The object is attained according to the invention by the provision of the at least one flexographic printing press having at least one roll unwinder. The at least one roll unwinder and the at least one roll winder are arranged on opposite sides of the at least one central cylinder.

The advantages achievable with the invention consist, in particular, in that by positioning a roll winder and a roll unwinder opposite the central cylinder, a more compact printing press configuration is possible. In particular, in the preferred embodiment the central cylinder is arranged between the roll unwinder and the roll winder. This enables the total length of the press to be reduced by 20% or more. The space savings results in a cost advantage for printing companies. The more compact configuration also results in a shorter transport path for the substrate web. In particular, the transport path of the substrate web is decreased by up to 5 meters or more.

Another advantage achievable with the invention consists, in particular, in that in a preferred embodiment, the roll unwinder is arranged on the side of the dryer unit and the roll winder is preferably arranged on the opposite side of the central cylinder, preferably on the side of the inspection device. This arrangement, in particular, advantageously enables a more compact configuration of the flexographic printing press. In particular, this arrangement makes a shortened transport path possible.

A further advantage achievable with the invention consists, in particular, in that the horizontal alignment of a dryer unit having at least two sections enables an even more compact configuration of the printing press. Moreover, an even more efficient and improved drying of the printing material is possible. The substrate web is preferably diverted between the at least two dryer sections, making efficient drying possible. Despite the more compact configuration, the transport path of the substrate web in the dryer unit is lengthened by at least one additional section. As a result, drying and solvent migration, in particular, are improved.

A further advantage achievable with the invention consists, in particular, in that web tension can be adjusted using a temperature control roller, in particular a cooling roller, preferably positioned immediately downstream of the dryer unit. Positioning the temperature control roller downstream of and close to the last guide element, for example at a distance of between 10 cm and 100 cm, also allows web tension to be adjusted simultaneously in the dryer, allowing additional draw rollers to be dispensed with and further contributing to a more compact configuration. The heat introduced into the printing material by the dryer unit can also be dissipated. Advantageously, the close and/or immediate proximity of the temperature control roller allows the heat to be dissipated directly downstream of the dryer unit and enables additional routing elements to be dispensed with.

The offset arrangement of the guide elements allows the web to be guided directly into the dryer unit. This particularly advantageously allows guide elements outside of the dryer unit to be dispensed with, contributing to a more compact configuration. The offset arrangement additionally ensures small diversion angles. Because at least two guide elements are provided, the compact web run has little contact surface area. Despite the more compact configuration of the press, a good quality printed product can be produced.

Another advantage achievable with the invention consists, in particular, in that a plurality of press parts, in particular roll winder, roll unwinder, central cylinder, forme cylinder, and draw rollers, have their own dedicated drives. In particular, the dedicated drives, which are preferably connected via a virtual master axis, enable a more compact configuration of the flexographic printing press.

BRIEF DESCRIPTION OF THE DRAWINGS

One exemplary embodiment of the invention is illustrated in the set of drawings and will be described in greater detail below.

The drawings show.

DESCRIPTION OF PREFERRED EMBODIMENT

Figure 1:
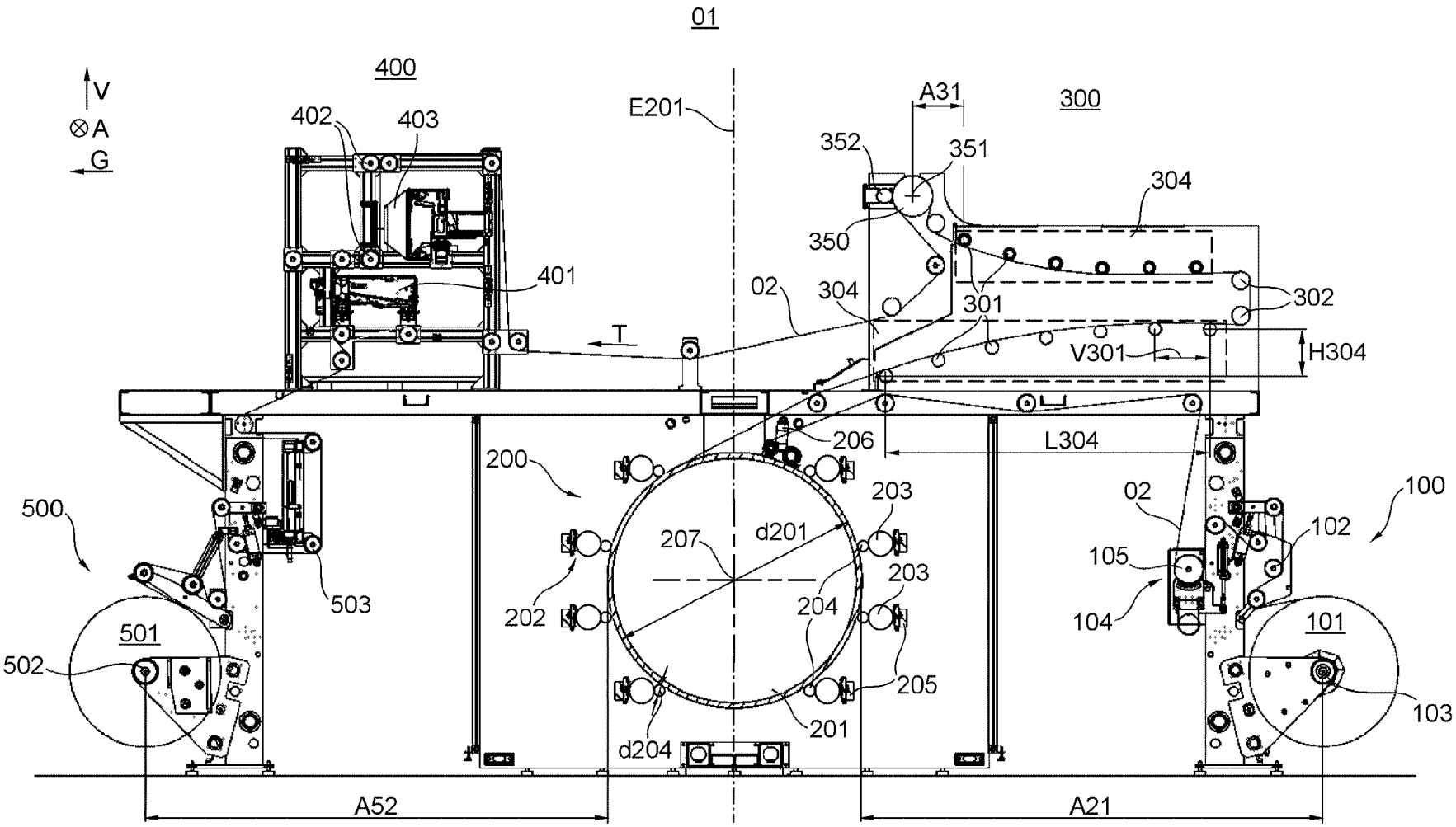
FIG. 1 a schematic representation of a flexographic printing press comprising a central cylinder.
Figure 2:
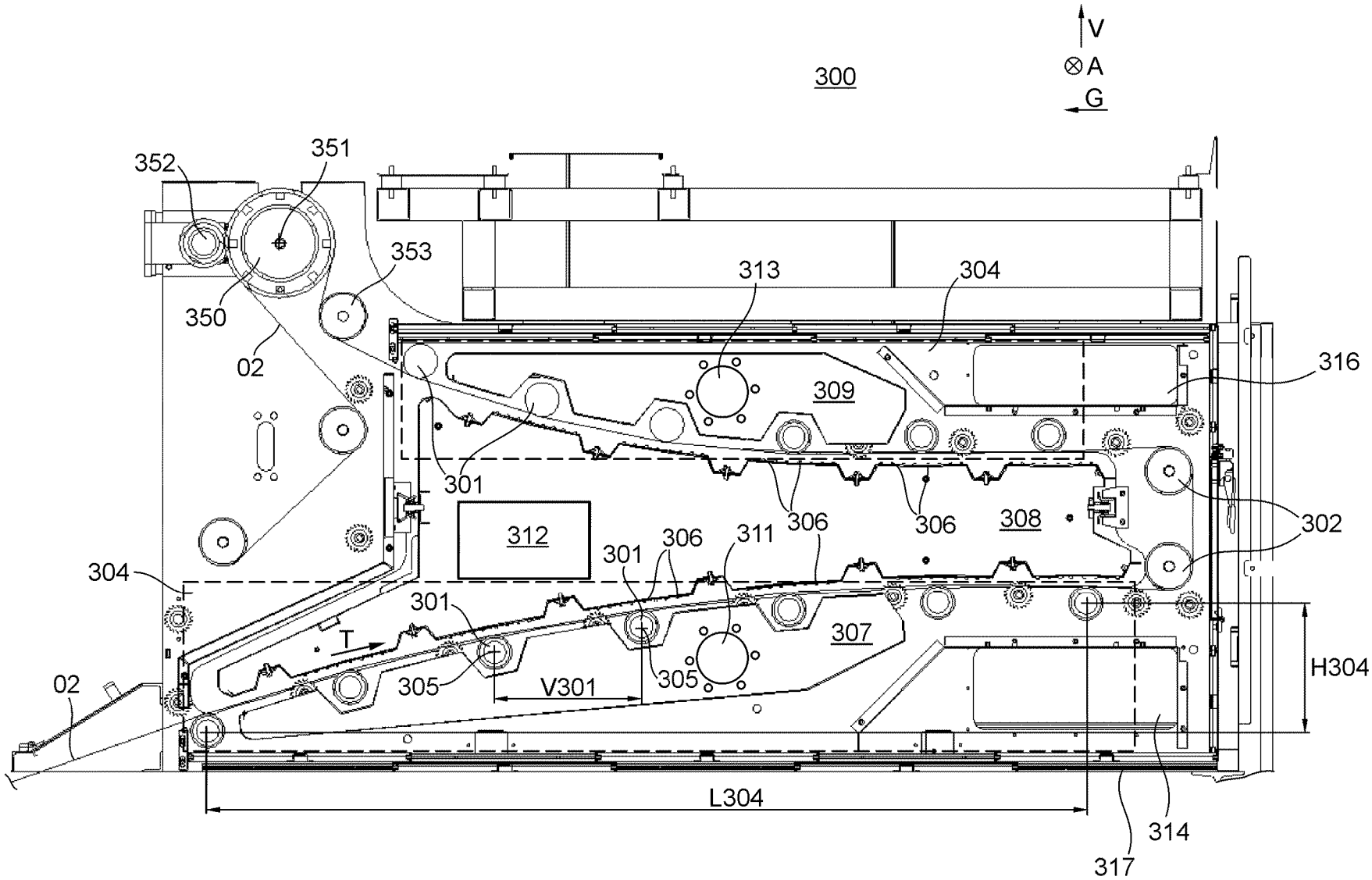
FIG. 2 a schematic representation of a horizontally oriented dryer unit.

A printing press 01, preferably a flexographic printing press 01 and/or a central cylinder printing press 01 (central impression (CI) cylinder), is embodied in particular as a web-fed printing press 01 for printing a web-format printing material 02. A printing press 01 is understood in this context as a machine that applies or is capable of applying at least one printing fluid to a printing material 02. The printing press 01, in particular flexographic printing press 01, comprises preferably at least one unwinder 100 having a printing material source 101, preferably at least one first printing assembly 200 having at least one central cylinder 201, preferably at least one first dryer unit 300, preferably at least one inspection device 400, and preferably at least one winder 500. The printing material source 101 is preferably in the form of a substrate roll 101 and/or a printing material roll 101. The printing press 01 optionally has at least one second printing assembly, for example, and at least one second dryer unit, for example. The maximum production speed is 5 m/s or 7 m/s, for example, preferably 6 m/s.

In the interest of simplicity, in the foregoing and in the following—unless otherwise explicitly distinguished and accordingly specified—the term "printing ink" or "printing fluid" is understood as a liquid or at least flowable coloring fluid to be used for printing in the printing press 01, and is not limited merely to the higher viscosity coloring fluids for use in rotary printing presses that are more frequently associated colloquially with the term "printing ink", but in addition to these higher viscosity coloring fluids particularly also includes lower viscosity coloring fluids such as "inks", in particular inkjet inks, but also powdered coloring fluids, such as toners, for example. Thus, in the foregoing and in the following, when printing fluids and/or inks and/or printing colors are mentioned, this also includes colorless varnishes. In the foregoing and in the following, when printing fluids and/or inks and/or printing colors are mentioned, this also preferably includes, in particular, means for pretreating (known as precoating) a printing material 02. The term coating medium is understood to be synonymous with the term printing fluid. The printing fluid used in flexographic printing presses, in particular, preferably has thin and low-viscosity properties as compared with printing fluids used in other printing processes.

The printing material 02 is preferably a web-format, flat material such as paper and/or cardboard and/or a thin, flexible or inflexible film. Packaging materials with a rough surface and fabric can also be printed. The working width of the printing press 01, in particular the flexographic printing press 01, is preferably between 600 mm and 1,200 mm, preferably up to 1,050 mm. In the foregoing and in the following, the working width is the maximum width a printing material 02 may have in order to be processable with the at least one printing assembly 200 of the printing press 01; this therefore corresponds to the maximum width of the respective printing material 02 that can be processed with the at least one printing assembly 200 of the printing press 01. Printing material webs and/or printing materials 02 having a maximum printing material weight of 120 g/m$^2$ or less are preferably used.

In the case of a web-fed printing press 01, the unwinder 100 is embodied as a roll unwinder 100 and the winder 500 is embodied as a roll winder 500. In the roll unwinder 100, preferably at least the printing material 02 is aligned, preferably at least with respect to one edge of said printing material 02. In the roll unwinder 100 of a web-fed printing press 01, at least one web-format printing material 02, i.e. a printing material web 02, is wound off of a printing material roll 101 and is preferably aligned with respect to its edges in an axial direction A. The axial direction A is preferably a direction A that extends parallel to an axis of rotation 207, in particular to an axis of rotation 207 of the central cylinder 201, of a horizontally extending direction A. The axial direction A, i.e. transverse direction A, is oriented orthogonally to a direction T, in particular direction of transport T, provided for the transport, in particular, of web-format printing material 02 and/or orthogonally to a transport path provided for the printing material 02 through the at least one first printing assembly 200. In the case of a curved transport path, the direction of transport T is preferably the specific direction T which is tangential to a respective reference point in each case, in particular tangential to the transport path and/or tangential to the transport path provided for the printing material web 02, in particular substrate web 02. More preferably, the direction of transport T is tangential to the transport path provided for the substrate web 02 at every point along the path.

At least one device 104 for increasing printing fluid adhesion, in particular a corona discharge device 104, is arranged downstream of the printing material roll 101 and downstream of at least one diverting means 102 in the transport path of the substrate web 02. In particular, the device 104 is arranged upstream of the at least one printing assembly 200, in particular upstream of the at least one printing unit 200, and downstream of the point where the substrate web 02 is wound off of the printing material roll 101. The device 104 preferably comprises a diverting means 105 and a device for treating the substrate web 02 with a corona voltage.

Downstream of the device provided for the support of the printing material roll 101, the transport path provided for transport of the at least one printing material 02 and in particular the printing material web 02 runs, preferably via at least one diverting means 102, through the at least one first printing assembly 200, where the printing material 02 and in particular the printing material web 02 is preferably furnished with a printed image on one side using at least one printing color. The transport path is considered to be the spatial area provided for the transport of a printing material 02, which is occupied at least temporarily by the printing material 02 and in particular the printing material web 02 when such material is present. The transport path is defined by at least one transport means, in particular by at least one printing material routing element. In each case, the at least one printing material routing element is preferably in the form of at least one roller and/or at least one cylinder and/or at least one support and/or at least one other device for guiding the printing material 02, and in particular the printing material web 02, while the printing press 01 is operating in a printing mode. The at least one printing unit 200 has, for example, at least one nip roller 206 and/or diverting roller 206 as a printing material routing element. The at least one nip roller 206 and/or diverting roller 206 is preferably arranged on the central cylinder 201 in such a way that a substrate web 02, in particular a printing material web 02, will be guided past the printing units 202 true to register, for example.

Other areas of the printing press 01 also have such printing material routing elements. For example, the dryer unit 300 has at least one diverting means 302 and at least one guide element 301, and the at least one roll unwinder 100 has at least one diverting means 102, and the inspection device 400 has at least one diverting means 402, and the at least one roll winder 500 has at least one diverting means 503 as such a transport means and/or as such a printing material routing element.

The printing press 01 further has a direction G. The direction G indicates the general direction of the transport path provided for the printing material 02 to travel through the printing press 01, and points from the at least one roll unwinder 100, in particular the beginning of the printing press 01, to the at least one roll winder 500, which is the end point of the printing press 01. The direction G, preferably the direction of transport G of the press as a whole, is oriented preferably orthogonally to the transverse direction A and parallel to the base of the printing press 01. In particular, the direction G is horizontal and/or is oriented horizontally.

In the foregoing and in the following, a vertical direction V refers to a direction which is preferably orthogonal to the plane spanned by the transverse direction A and direction G. The vertical direction V together with the transverse direction A and the direction G preferably form a Cartesian system of coordinates. In particular, with a direction of transport G that runs parallel to the floor, the vertical direction V preferably points away from the floor on which the printing press 01 is standing.

The at least one first printing unit 200 is preferably configured as a flexographic printing assembly 200 comprising at least one central cylinder 201 and having at least one and preferably a plurality of printing couples, preferably at least four, more preferably at least eight printing couples 202 around the periphery of the at least one central cylinder 201. In a particularly preferred embodiment, the printing press 01 has a total of eight printing couples 202. The at least one printing couple 202 is preferably positionable by means of power-driven and/or manually operated adjusting screws. In each case, the at least one printing couple 202 preferably comprises at least one anilox roller 203, at least one forme cylinder 204, and at least one doctor blade device 205.

The at least one anilox roller 203 of one of the printing couples 202 has a plurality of cells distributed evenly over the anilox roller 203 for applying ink to the at least one forme cylinder 204. The screen count ranges in particular from 200 cells/cm to 600 cells/cm. The anilox roller 203 is a chrome roller or ceramic roller, for example. The at least one forme cylinder 204 is preferably equipped with a flexible, raised printing forme. The printing length is preferably up to 500 mm or up to 1,100 mm, preferably up to 800 mm. The at least one doctor blade device 205 is preferably embodied as a closed system. In a preferred embodiment, the forme cylinder 204 and/or each forme cylinder 204 has its own drive and/or direct drive. Each of these drives is preferably coupled to a virtual master axis.

The central cylinder 201 preferably has its own first drive motor assigned to the first central cylinder 201, which is preferably in the form of an electric motor and which is more preferably a direct drive and/or individual drive of the central cylinder 201. The diameter d201 of the central cylinder 201 is preferably between 1 meter and 3 meters, preferably between 1.5 meters and 2 meters or more. In particular, the diameter d201 of the at least one central cylinder 201 is at least three times, preferably at least four times the diameter d204 of the at least one forme cylinder 204 of one of the printing couples 202. The vertical direction V and the axis of rotation 207 of the central cylinder 201 span a plane E201. The at least one printing couple 202, in particular the plurality of printing couples 202, are arranged evenly on the opposing sides of the at least one central cylinder 201. In particular opposite with respect to the plane E201. The plurality of printing couples 202 are preferably arranged in the shape of a star around the at least one central cylinder 201. The nip pressure during printing operation is preferably between 0.1 MPa and 0.5 MPa.

The at least one dryer unit 300 is preferably arranged downstream of the at least one printing unit 200 in the transport path provided for the substrate web 02. Preferably, the at least one dryer unit 300 is arranged in the vertical direction V above the at least one printing unit 200, more preferably above the axis of rotation 207 of the at least one central cylinder 201. In particular, the at least one dryer unit 300 is more preferably arranged on the side of the roll unwinder 100, separated by the plane E201. The dryer unit 300 has at least one, preferably at least two, more preferably exactly two dryer sections 304 through which the substrate web 02 is to be guided. The at least one, preferably at least two, more preferably exactly two dryer sections 304 are preferably enclosed by a housing 317.

Positioned upstream and/or downstream of one dryer section 304 is at least one diverting means 302 for changing the direction of transport T of the substrate web 02 and/or for altering the transport path provided for the substrate web 02. In particular, the at least one diverting means 302 is arranged so as to align the substrate web 02 to be guided into and/or out of the dryer section 304, without a large diversion angle around at least a first guide element, and/or one guide element, and/or a last guide element 301 of the respective dryer section 304. More preferably, the at least one diverting means 302 is arranged in each case such that the at least one diverting means 302 extends a monotonically ascending arrangement of the guide elements 301.

For each dryer section 304, the at least one dryer unit 300 comprises at least one and preferably a plurality of guide elements, at least four, more preferably at least seven guide elements 301. The at least one guide element 301, in particular the plurality of guide elements 301, preferably defines the transport path provided for the substrate web 02 within a dryer section 304. In particular, the at least one guide element 301, in particular the plurality of guide elements 301, is/are arranged offset from one another in a direction of transport T and/or in the direction G and more preferably also in a vertical direction V. In the case of at least two guide elements 301, the distance between the guide elements 301, in particular an offset V301 of the axes of rotation 305 of the guide elements 301, parallel to the direction G, is preferably between 10 cm and 30 cm. More preferably, in the case of a plurality of guide elements 301, the distance, in particular the offset V301 parallel to the direction G, is the same in each case. In the case of a plurality of guide elements 301, the guide elements 301 are preferably arranged ascending monotonically in a vertical direction V at least in the first dryer section 304, preferably in all dryer sections 304. A preferably convex configuration results, in particular, for the transport path provided for the substrate web 02. Convex, in particular, in relation to a straight line connecting the first guide element to the last guide element 301 of a dryer section 304. In another embodiment, the plurality of guide elements 301 are preferably arranged so as to produce an approximately logarithmically ascending transport path in the vertical direction V for the substrate web 02 through the respective dryer section 304.

At least two successive dryer sections 304 of the dryer unit 300 are preferably arranged opposite one another. Opposite here means, in particular, that the substrate web 02 passes through the at least one dryer unit 300 with the substrate web 02 rotated and/or turned over, in particular with the printed surface of the substrate web 02 rotated and/or turned over. In particular, the substrate web 02 is rotated by the at least one diverting means 302, which is arranged downstream of the respective dryer section 304 and upstream of the next dryer section 304 in each case. At least one diverting means 302 is preferably arranged between each dryer section 304 in such a way that the at least one substrate web 02 is rotated upstream of each dryer section 304 by at least one diverting means 302, and/or the substrate web 02 and/or the transport path provided for the substrate web 02 is diverted by 135° to 225°, preferably by 180°. For example, each diverting means 302 diverts the substrate web 02 and/or the transport path provided for the substrate web 02 by an angle of approx. 90°, so that the at least two diverting means 302 together divert the substrate web 02 or the transport path provided for the substrate web 02 by 135° to 225°, preferably by 180°. In a further embodiment, two dryer sections 304 have one common diverting means 302 and/or more than two diverting means 302, and the substrate web 02 is preferably diverted a total of 135° to 225°, preferably 180°, by the at least one diverting means 302. In particular, a printed surface of the substrate web 02 that is facing upward will be turned facing downward after being diverted by the at least one diverting means 302. In one embodiment, the at least one diverting means 302 is arranged such that the printed surface, which has already been surface-dried in the first dryer section 304, comes into contact with the diverting means 302. The at least one diverting means 302 is preferably cylindrical over the entire working width in the transverse direction A. In particular, the at least one diverting means 302 is not driven and is embodied as an idle diverting roller 302. The at least one diverting means 302 is preferably rotatable about an axis of rotation. Two dryer sections 304 are preferably separated by two diverting rollers 302.

At least one nozzle 306, preferably a plurality of nozzles 306, is/are assigned to the substrate web 02 or to the transport path provided for the substrate web 02 through the respective dryer section 304. The plurality of nozzles 306 in each dryer section 304 are arranged pointing from above and from below onto the substrate web 02 and/or onto the transport path of the substrate web 02. The distance between the substrate web 02 and/or the transport path is preferably less than 20 cm, preferably less than 10 cm. The plurality of nozzles 306 are preferably arranged, in particular, on a plurality of nozzle boxes 307; 308; 309. In particular, the nozzle boxes 307; 308; 309 or the sections on the nozzle boxes 307; 308; 309 are preferably arranged offset in the vertical direction V and are arranged to conform to the preferably convex configuration of the transport path of the substrate web 02. In particular, the nozzles 306 of a nozzle box 308 located above the substrate web 02 and/or above the transport path of the substrate web 02 are arranged in such a way that a concave configuration of the nozzle arrangement in relation to a straight line connecting the first and last nozzles 306 in the transport path is formed. In particular, each dryer section 304 has at least one, preferably two nozzle boxes 307; 308; 309. In the particularly preferred embodiment comprising two dryer sections 304, the first dryer section 304 preferably has one nozzle box 308 above and one nozzle box 307 below the substrate web 02 and/or the transport path provided for the substrate web 02. The second dryer section 304 likewise has one nozzle box 309 above and one nozzle box 308 below the substrate web 02 and/or the transport path of the substrate web 02. Above and below are meant here as indicators in a primarily vertical direction V, in particular. Each nozzle box 307; 308; 309 preferably has its own gas inlet 311; 312; 313. The particularly preferred embodiment comprising two dryer sections 304 has a lower, a middle, and an upper nozzle box 307; 308; 309, for example. The nozzle boxes 307; 308; 309 preferably have a lower, a middle, and an upper gas inlet 311; 312; 313. The at least one housing 317 particularly preferably has at least two gas outlets 314; 316, one lower and one upper. In an embodiment of the dryer unit 300 that comprises a plurality of dryer sections 304, fewer or more gas outlets or gas inlets may also be present. In the case involving the two dryer sections 304, the nozzle box 308 is particularly preferably configured as a shared nozzle box 308. The nozzle box 308 which is shared by the two successive dryer sections 304 has a plurality of nozzles 306 with a plurality of nozzle openings. The nozzle openings of the shared nozzle box 308 of the at least two successive dryer sections 304 are arranged pointing away from one another, in particular. In an embodiment comprising a plurality of dryer sections 304, in particular, the two successive dryer sections 304 preferably always have one shared nozzle box 308 with nozzle openings that point away from one another.

The plurality of nozzles 306 are preferably arranged evenly across the dryer section 304. For example, the nozzles 306 on one nozzle box 307; 308; 309 are arranged offset from one another. The turning and/or the rotating and/or the diverting of the substrate web 02 between two dryer sections 304, in particular, causes the plurality of nozzles 306 of the shared nozzle box 308 to be directed toward the printed side of the substrate web 02. The plurality of nozzles 306 preferably are and/or can be supplied with preheated drying gas, e.g. drying air, by means of a gas inlet. In one embodiment, each dryer section 304 has one common gas flow for drying the substrate web 02 and for the migration of solvent. In another preferred embodiment, each nozzle box 307; 308; 309 has its own gas inlet. In a further preferred embodiment, two successive dryer sections 304 are always supplied with drying air by means of one common supply. The dryer unit 300 as a whole preferably has one common drying inlet. In another embodiment, the dryer unit 300 is in the form of an infrared dryer.

The at least one dryer unit 300 is preferably arranged in a horizontal alignment and/or horizontal orientation, in particular. A horizontal alignment means, in particular, a largely horizontal, in particular predominantly horizontal component, in particular the component parallel to the direction G, of the direction of transport T of the substrate web 02 in the dryer unit 300, preferably in each dryer section 304. In particular, the direction of transport T is tangential to the transport path provided for the substrate web 02 within a dryer section 304. The component of the direction of transport which is oriented horizontally and parallel to the direction G predominates in at least 80%, preferably 90%, more preferably 100%, of the transport path within the respective dryer section 304.

More preferably, a horizontal alignment of the at least one dryer unit 300 also refers to the dimensions of the individual dryer sections 304. In particular, the length L304 of the dryer section 304 is greater than the height H304 of the respective dryer section 304. In particular, the length L304 of the dryer section 304 refers to the distance from the first to the last guide element 301, in particular the respective axes of rotation 305 of the guide elements 301, of a dryer section 304 parallel to the direction G. The height H304 of the dryer section 304 refers in particular to the height H304 between the first and the last guide element 301, in particular the respective axes of rotation 305 of the guide elements 301, of the respective dryer section 304 parallel to the vertical direction V. For example, L304 is between 1 meter and 3 meters and H304 is between 10 cm and 50 cm. The at least one horizontally oriented and/or aligned dryer unit 300 having the at least one guide element 301 is preferably arranged above the printing unit 200 in a vertical direction V.

Downstream of the at least one last, preferably the second, dryer section 304, at least one temperature control roller 350 is arranged. The at least one temperature control roller 350, preferably at least one cooling roller 350, is arranged downstream of the at least one horizontally arranged dryer unit 300 and upstream of the inspection device 400. The at least one temperature control roller 350 is more preferably arranged between the at least one dryer unit 300 and the plane E201. At least one dynamometer 353 is preferably arranged between the last dryer section 304 and the at least one temperature control roller 350. The at least one dynamometer 353 is particularly arranged on at least one roller. The diameter of the at least one temperature control roller 350 is preferably between 200 mm and 350 mm, more preferably between 250 mm and 300 mm. The temperature of the at least one temperature control roller 350 is controlled to a temperature of preferably 18° C. to 24° C., preferably cooled, preferably by means of a temperature control medium, in particular water. In particular, the temperature control medium is conducted and/or made to flow in the transverse direction A through the at least one temperature control roller 350 by means of temperature control channels. In particular, the distance A31 parallel to the direction G from the dryer unit 300, in particular from the axis of rotation 305 of the last guide element 301, to the axis of rotation 351 of the at least one temperature control roller 350 is short, in particular shorter than the length L304 through the respective last dryer section 304. In particular, the distance A31 parallel to the direction G from the last guide element 301 of the last dryer section 304 to the axis of rotation 351 of the at least one temperature control roller 350 is preferably half as short, even more preferably one-quarter as short as the length L304 of the respective last dryer section 304. Preferably, the distance A31 is between 10 cm and 100 cm. More preferably, the distance A31 is between 10 cm and 50 cm. In a further preferred embodiment, the distance A31 is shorter than half as short and/or shorter than one-third as short and/or shorter than one-quarter as short as the length L304 of the respective last dryer section 304. At least one pressure roller 352 is set against the at least one temperature control roller 350. The pressure roller 352 is used in particular for pressing the substrate web 02 against the at least one temperature control roller 350. The at least one temperature control roller 350 is preferably driven by an electric motor. The at least one temperature control roller 350 is driven by a drive, preferably an electric motor. The drive is preferably controlled in a closed loop with respect to speed and/or position and/or torque. In particular, the at least one temperature control roller 350 is arranged for open-loop and/or closed-loop control of the web tension of the substrate web 02, preferably in operative connection to the at least one dynamometer 353. The drive is further preferably embodied as a direct drive and/or a separate dedicated drive and is coupled to other drives of the printing press 01 by means of a virtual master axis.

The at least one printing press 01 further has an inspection device 400 arranged downstream of the dryer unit 300 in the transport path of the substrate web 02. In particular, the inspection device 400 has at least one sensor device 403 for inspecting perfecting register and/or one sensor device 401 for print image analysis. Perfecting register refers to the precise alignment of printed images on the front and back sides of a printing material 02 that is printed on both sides (DIN 16500-2). The precise merging of individual print images that are printed by different printing couples 202, in multicolor printing for example, to form a single image is referred to as color register according to DIN 16500-2. In the foregoing and in the following, a print image describes a representation on the printing material 02 that corresponds to the sum of all print image elements, the image elements being transferred and/or transferable to the printing material 02 during at least one operating step and/or at least one printing procedure.

The inspection device 400 is preferably arranged above the printing unit 200 and in particular above the central cylinder 201 in the vertical direction V. The inspection device 400 is preferably arranged between the roll winder 500 and the dryer unit 300 in the transport path.

The distance of the sensor device 401 for print image analysis and/or the sensor device 403 for inspecting perfecting register from the substrate web 02 and/or from the transport path provided for the substrate web 02 preferably is at least 5 mm, preferably at least 8 mm, and at most 20 mm, more preferably at most 15 mm. The sensor device 401 for print image analysis and/or the sensor device 403 for inspecting perfecting register therefore preferably has a minimum distance from the transport path and/or from a diverting means 402 which is assigned to the sensor devices 401; 403 and preferably defines the transport path, which minimum distance corresponds to the thickness of the respective printing material web 02 and additionally is at least 5 mm.

The sensor device 401 and/or the sensor device 403 is preferably in the form of an image sensor 401; 403, in particular a line camera, more preferably a contact image sensor (CIS). The sensor device 401 and/or the sensor device 403 preferably comprises at least one sensor, at least one lens assigned to the respective sensor, and/or at least one light source assigned to the respective sensor. In a preferred embodiment, the sensor device 401 and/or the sensor device 403 comprises a multiplicity of sensors and the respectively associated lenses and/or light sources. The at least one sensor is preferably embodied as a CCD sensor and/or CMOS sensor. The sensor is preferably in the form of a photodiode and/or preferably defines a respective image point, in particular a pixel, the pixel preferably being rectangular, in particular square. A photodiode is preferably a semiconductor diode which converts visible light, for example, into an electric voltage through an internal photo effect. The sensor is preferably configured to detect at least one piece of brightness information from the respective print image and to convert the respective brightness information to electric voltage.

The printing press 01 further comprises at least one roll winder 500. The at least one roll winder 500 is preferably arranged downstream of the at least one inspection device 400. The at least one roll winder 500 comprises a substrate roll 501, in particular a printing material roll 501, on which the substrate web 02 is wound after printing. The at least one printing material roll 501 and/or the position provided for the printing material roll 501 in the at least one roll winder 500 further has an axis of rotation 502. The roll winder 500 further comprises at least a plurality of diverting means 503 for guiding and aligning the substrate web 02. The at least one roll unwinder 100 and the at least one roll winder 500 are preferably arranged on opposite sides of the at least one central cylinder 201. In particular, the at least one roll unwinder 100 and the at least one roll winder 500 are arranged separated from one another spatially by the at least one printing unit 200. In particular, at least the at least one central cylinder 201 of at least one printing unit 200 is arranged such that the axis of rotation 207 of the at least one central cylinder 201 is arranged between them in the direction G.

The roll unwinder 100 is preferably arranged to the side of the dryer unit 300. The roll winder 500 is arranged opposite the roll unwinder, preferably separated by the central cylinder 201. The roll winder 500 is preferably arranged to the side of and preferably below the inspection device 400.

The roll unwinder 100 and the roll winder 500 preferably each have a separate, dedicated drive or individual drive and/or direct drive. In a preferred embodiment, the separate, dedicated drives of the roll unwinder 100 and of the roll winder 500 are embodied as electric motors and are preferably coupled to other machine parts, for example, by means of a virtual master axis. In a preferred embodiment, the flexographic printing press 01 has a plurality of individual drives and/or direct drives. The individual drives and/or direct drives are preferably coupled by means of a virtual master axis. Preferably, via the master axis, at least the drives of the central cylinder 201 and the roll winder 500 and the roll unwinder 100, and more preferably also the drives of the at least one temperature control roller 350 and of the forme cylinder 204 are coupled.

Gaps are arranged, in particular, between the at least one roll unwinder 100 and the printing unit 200 and between the at least one roll winder 500 and the printing unit 200. These gaps are preferably to be viewed in parallel to direction G. The shortest distance A21 between the roll unwinder 100, in particular the axis of rotation 103 of the printing material roll 101 or the axis of rotation 103 of the position provided for the printing material roll 101 in the roll unwinder 100, and the at least one central cylinder 201, in particular a point on the lateral surface of the central cylinder 201, is preferably no greater than four times the diameter d201 of the central cylinder 201. More preferably it is no greater than three times and/or twice the diameter d201 of the central cylinder 201.

The shortest distance A52 between the roll winder 500, in particular the axis of rotation 502 of the substrate roll 501 or the axis of rotation 502 of the position in the roll winder 500 provided for the substrate roll 501, and the central cylinder 201, in particular a point on the lateral surface of the central cylinder 201, is preferably no greater than four times the diameter d201 of the central cylinder 201. More preferably, the distance A52 is no greater than three times and/or twice the diameter d201 of the at least one central cylinder 201.

While a preferred embodiment of a flexographic printing press for printing a substrate web, in accordance with the present invention, has been set forth fully and completely hereinabove, it will be apparent to one of skill in the art that various changes could be made thereto, without departing from the true spirit and scope of the present invention which is accordingly to be limited only by the appended claims.

The invention claimed is:

1. A flexographic printing press for printing a substrate, comprising;

at least one printing unit having at least one central cylinder;

a plurality of printing couples arranged around a periphery of the at least one central cylinder;

at least one roll winder in the flexographic printing press;

at least one roll unwinder in the flexographic printing press, wherein the at least one roll unwinder is arranged on a first side of the at least one central cylinder and the at least one roll winder is arranged on a second, opposite side of the at least one central cylinder and wherein the at least one central cylinder is arranged between the at least one roll unwinder and the at least one roll winder;

at least one horizontally aligned dryer unit having at least one guide element, the at least one horizontally aligned dryer unit being arranged above the printing unit in a vertical direction (V) and being arranged on the first side of the at least one central cylinder; and at least first and second dryer sections in the at least one horizontally aligned dryer unit, wherein the first dryer section is arranged separated from the second dryer section of the at least first and second dryer sections by at least one diverting means, and wherein a shortest distance (A21) between the at least one roll unwinder and the at least one central cylinder is not greater than twice a diameter of the central cylinder, and wherein a shortest distance (A52) between the at least one roll winder and the at least one central cylinder is not greater than twice the diameter of the central cylinder.

2. The flexographic printing press according to claim 1, wherein the flexographic printing press has at least one temperature control roller and wherein the at least one temperature control roller is arranged downstream of a last dryer section of the at least first and second dryer sections of the at least one dryer unit in a transport path of the substrate web.

3. The flexographic printing press according to claim 2, wherein a third distance (A31) from a last guide element of the last dryer section of the at least one dryer unit to the at least one temperature control roller is between 10 cm and 100 cm.

4. The flexographic printing press according to claim 2, wherein a fourth distance (A31) from a last guide element of a last dryer section of the at least one dryer unit to the at least one temperature control roller is half as short as a length of a transport path of the substrate web through the respective last dryer section, and wherein the fourth distance is referred to as a length (L304) of a transport path of the substrate web, parallel to a direction (G) of the transport path of the substrate web, from a first guide element to a last guide element of the last dryer section in a direction of transport (T) of the substrate web.

5. The flexographic printing press according to claim 2, wherein the at least one temperature control roller is driven by at least one drive, and wherein the at least one temperature control roller is arranged for one of open-loop and closed-loop control of a web tension of the substrate web.

6. The flexographic printing press according to claim 2, wherein a dynamometer is arranged between the at least one temperature control roller and a last one of the at least first and second dryer sections.

7. The flexographic printing press according to claim 2, wherein the at least one temperature control roller is arranged between the at least one dryer unit and a plane (E201), and wherein the plane (E201) is spanned by a vertical direction V and by an axis of rotation of the central cylinder.

8. The flexographic printing press according to claim 1, wherein an inspection device for one of inspecting perfecting register and for print image analysis is arranged downstream of the at least one dryer unit in a transport path of the substrate web.

9. The flexographic printing press according to claim 8, wherein at least one temperature control roller is arranged downstream of the at least one horizontally arranged dryer unit and upstream of the inspection device.

10. The flexographic printing press according to claim 1, wherein the at least first and second dryer sections have at least two guide elements and wherein the at least two guide elements are arranged offset from one another in a direction (G) of a transport path of the substrate web and in the vertical direction (V).

11. The flexographic printing press according to claim 1, wherein the at least one diverting means is arranged between each dryer section of the at least first and second dryer sections, such that the substrate web is rotated upstream of each dryer section by the at least one diverting means and one of wherein the substrate web and a transport path provided for the substrate web is diverted by between 135° and 225°.

12. The flexographic printing press according to claim 1, wherein each dryer section of the at least first and second dryer sections has a plurality of nozzles and wherein the plurality of nozzles of each dryer section are arranged pointing from above and from below one of onto the substrate web and onto a transport path of the substrate web.

13. The flexographic printing press according to claim 1, wherein the at least first and second dryer sections are arranged separated by first and second diverting means.

14. The flexographic printing press according to claim 1, wherein the at least first and second dryer sections are enclosed by at least one housing.

15. The flexographic printing press according to claim 1, wherein the shortest distance (A21) between an axis of rotation of the printing material source and a point on a lateral surface of the central cylinder is no greater than twice the diameter (d201) of the central cylinder, and wherein the shortest distance (A52) between an axis of rotation of the substrate roll and a point on the lateral surface of the central cylinder is no greater than twice the diameter (d201) of the central cylinder.

* * * * *